US006608538B2

(12) United States Patent
Wang

(10) Patent No.: US 6,608,538 B2
(45) Date of Patent: Aug. 19, 2003

(54) SMALL SIZE CROSS-COUPLED TRISECTION FILTER

(75) Inventor: Chin-Li Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/883,987

(22) Filed: Jun. 20, 2001

(65) Prior Publication Data

US 2002/0113669 A1 Aug. 22, 2002

(30) Foreign Application Priority Data

Feb. 22, 2001 (TW) ..... 90104019 A

(51) Int. Cl.[7] ..... H01P 1/203
(52) U.S. Cl. ..... 333/204; 333/219; 333/185
(58) Field of Search ..... 333/204, 219, 333/202, 238, 246, 134, 136, 125, 192, 177, 185

(56) References Cited

U.S. PATENT DOCUMENTS 5,382,925 A * 1/1995 Hayashi et al. ..... 333/112
6,208,226 B1 * 3/2001 Chen et al. ..... 333/202
6,294,967 B1 * 9/2001 Hirai et al. ..... 333/202
6,323,745 B1 * 11/2001 Toncich ..... 333/204
6,504,451 B1 * 1/2003 Yamaguchi ..... 333/177

OTHER PUBLICATIONS

Yang et al, IEEE Microwave and Guided Wave Letters, vol. 9, No. 7, pp. 271–273 (1999).

Hong et al, IEE Proc–Microw Antennas Propag., vol. 146, No. 1, pp. 84–90 (1999).

* cited by examiner

*Primary Examiner*—Robert Pascal
*Assistant Examiner*—Dean Takaoka
(74) *Attorney, Agent, or Firm*—Birch, Stewart, Kolasch & Birch, LLP

(57) ABSTRACT

The present invention relates to a three-order filtering structure. Each resonator includes an inductive portion and a capacitive portion. The inductive portion of the second resonator is folded that the inductive portion of the first resonator is coupled to the inductive portion of the third resonator forming a trisection filtering structure. The cross-couple between resonator 1 and 3 adds additional finite transmission zero below the passband.

13 Claims, 8 Drawing Sheets

Appendix A
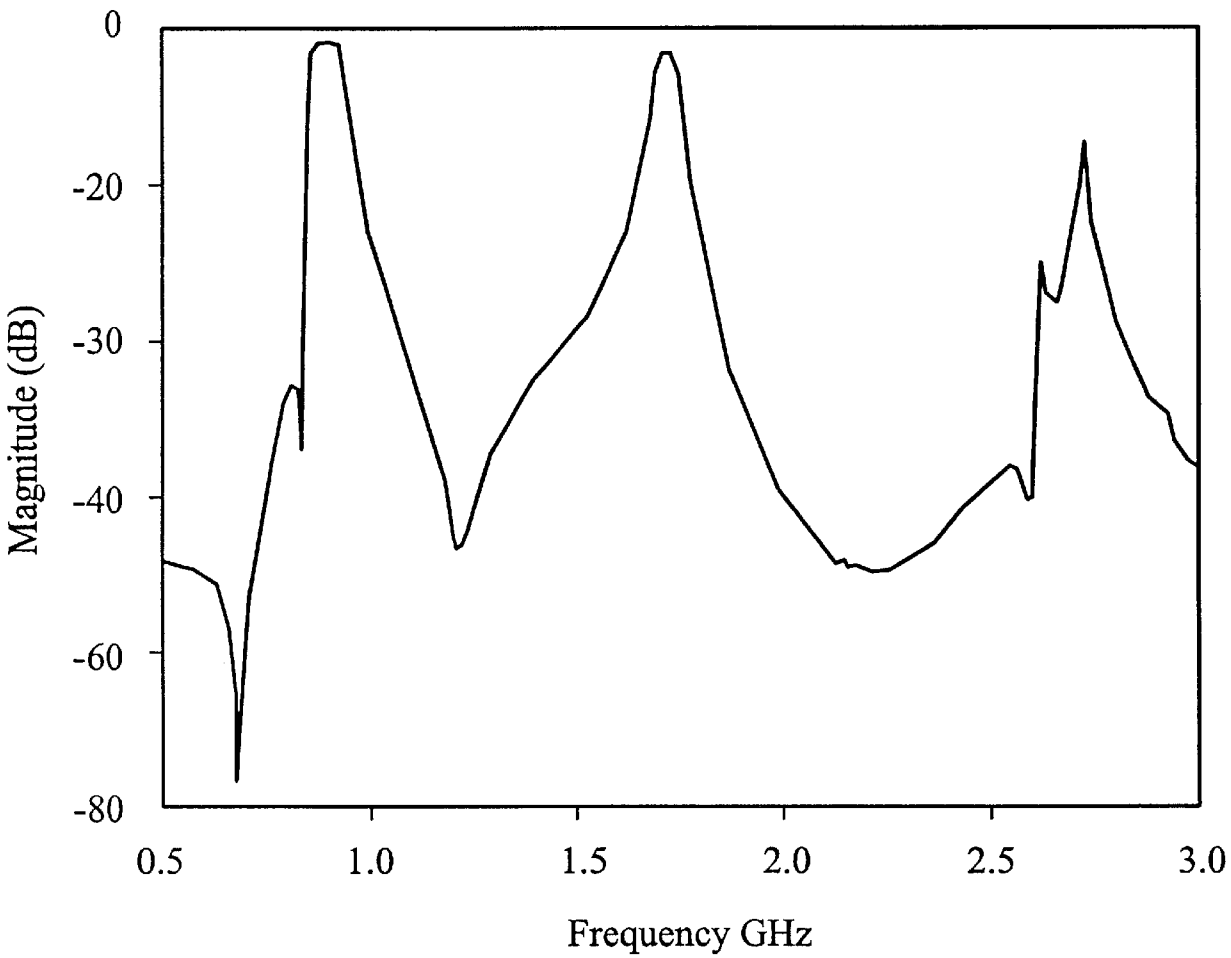

Appendix B
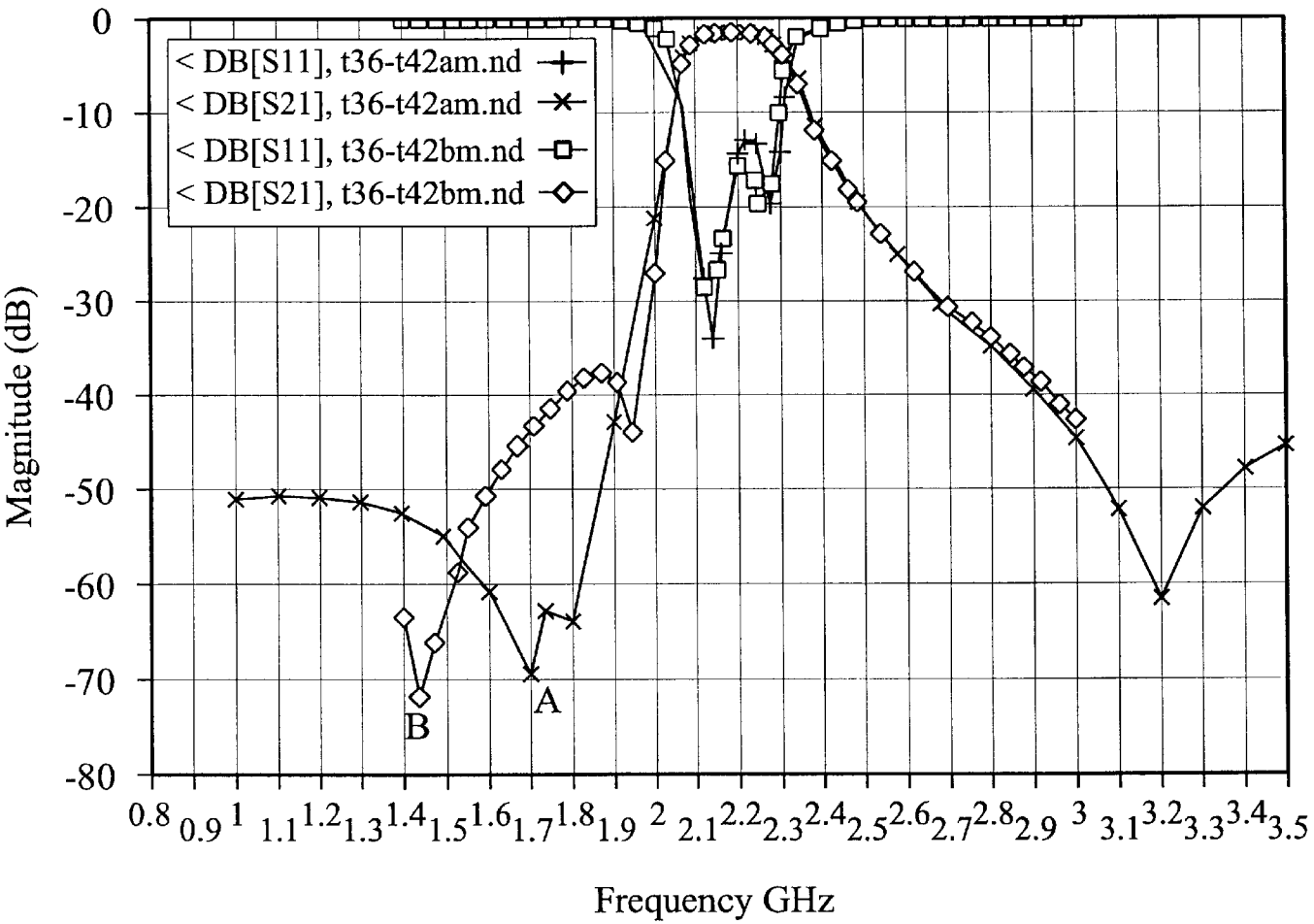

Appendix C
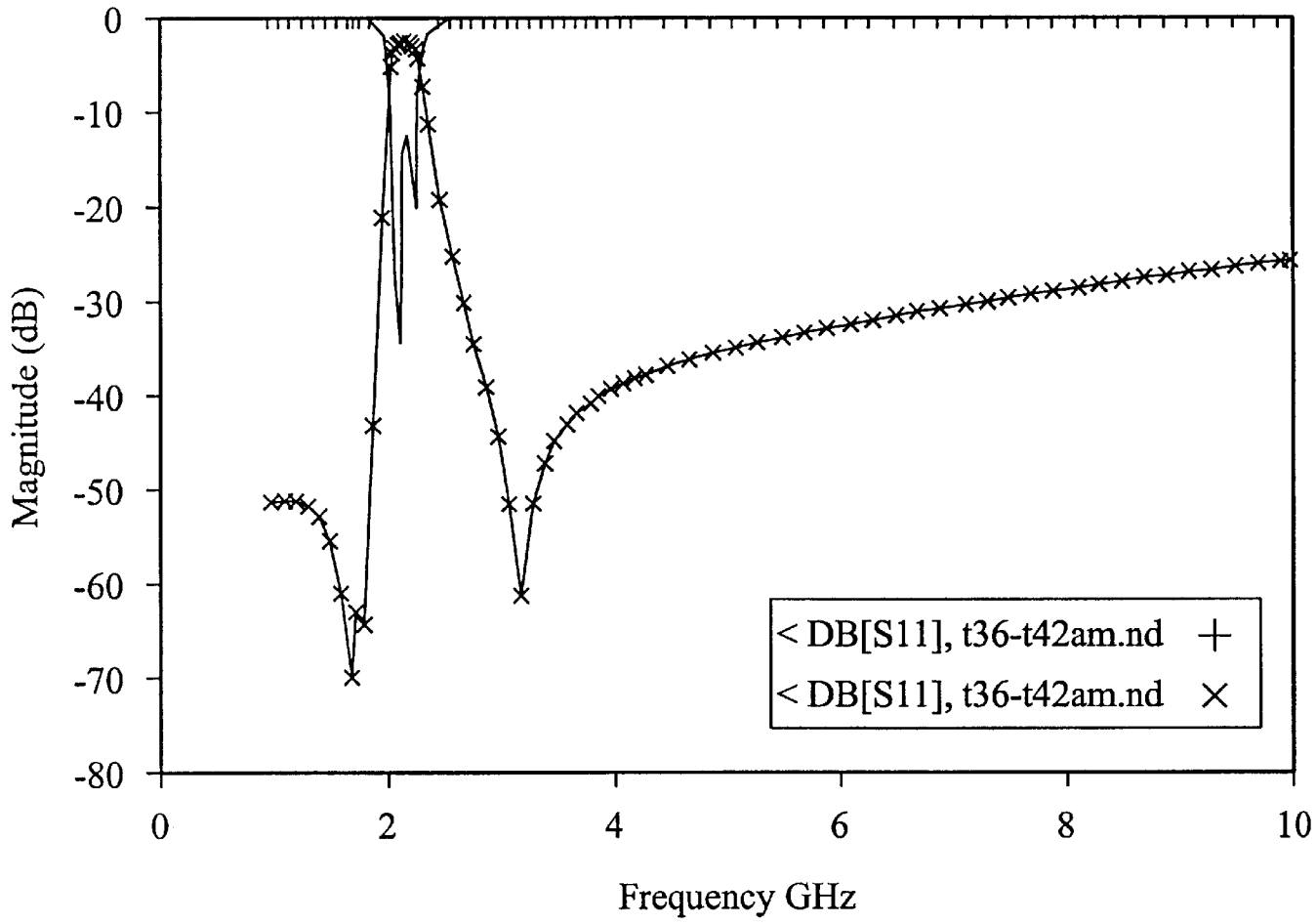

SMALL SIZE CROSS-COUPLED TRISECTION FILTER

BACKGROUND OF THE INVENTION

1. Field of the Invention

The present invention relates to a cross-coupled trisection filter, with inductance and capacitance devices, thereby reducing its physical size and increasing the production yield.

2. Description of Related Art

According to the filter design specification, if the degree of the resonator is increased, the selectivity of the frequency band is increased. However, this is accompanied with bandpass attenuation C and an increase in physical size. Refer to FIG. 1 for a prototype of a cascade trisection bandpass filter. As shown in FIG. 1, any cascade trisection bandpass filter generally provides asymmetric frequency response. Conventional bandpass filters with asymmetric response are further described in "Microstrip Cross-coupled trisection bandpass filters with asymmetric frequency characters" by J. -S. Hong and M. J. Lancaster, as shown in FIG. 2*a*, and in "Microstrip Cascade Trisection Filter" by Chu-Chen Yang and Chin-Yang Chang, as shown in FIG. 2*b*. The resonators R1*a*, R2*a*, and R3*a* in FIG. 2*a* are construed on a substrate sun, wherein the resonator R1*a* has an input port IN and the resonator R3*a* has an output port OUT. The resonators R1*b*, R2*b*, R3*b*, R4*b*, and R5*b* in FIG. 2*b* are construed on a substrate (not shown), wherein the resonator R5*a* has an input port P1 and the resonator R3*a* has an output port P2. As shown in FIG. 2*a*, the 3-pole filter structure is composed of three $\lambda/2$-line open-loop resonators R1*a*, R2*a*, R3*a* on one side of the dielectric substrate SUB with a ground plane on the other side. The cross coupling between resonators R1*a* and R3*a* exists because of their proximity. An attenuation pole of finite frequency exists on the high side of the pass band due to the cross-coupling. As shown in FIG. 2*b*, the 5-pole filter with two $\lambda/2$-line open-loop resonators and three hairpin resonators has mixed (electric and magnetic) couplings between resonators R1*b* and R2*b* and between resonators R2*b* and R3*b*, the mixed couplings between resonators R3*b* and R4*b* and between resonators R4*b* and R5*b*. The lower attenuation pole is due to the nonadjacent magnetic coupling between resonators R1*b* and R3*b*, and the upper attenuation pole is due to the nonadjacent electric coupling between resonators R3*b* and R5*b*. Thus, both FIGS. 2*a* and 2*b* can achieve a higher selectivity without increasing the degree of poles, i.e. the number of resonators. However, such a structure exhibits increased size and easily suffers spurious effect on odd frequencies of the band pass (see the appendix A), so the required level of filtration is not achieved.

SUMMARY OF THE INVENTION

Accordingly, an object of the invention is to provide a filtering structure, which adds a serial capacitance device into each resonator of the filter in FIG. 1 to reduce the filter size.

Another object of the invention is to provide a small size cross-coupled trisection filtering structure, which uses the semi-lumped LC resonator to avoid the spurious effect and also keep the attenuation pole on the high frequency during the band pass.

Another object of the invention is to provide a small size cross-coupled trisection filtering structure, which only couples to the high impedance transmission portion of the resonators, thereby fitting a multilayer and easily adjusting the frequency of an attenuation pole by changing the high impedance transmission distance of the first and third poles without changing the bandpass characteristics.

The invention provides a small size cross-coupled trisection filter structure, including a first resonance unit; a second resonance unit; and a third resonance unit. Each of the units includes an inductance device, e.g. a transmission line, and a capacitance device, e.g. a capacitor, wherein the high impedance transmission portions of two of the units are coplanar and one has an input while the other has an output.

BRIEF DESCRIPTION OF THE DRAWINGS

The invention will become apparent by referring to the following detailed description of a preferred embodiment with reference to the accompanying drawings, wherein.

Figure 1:
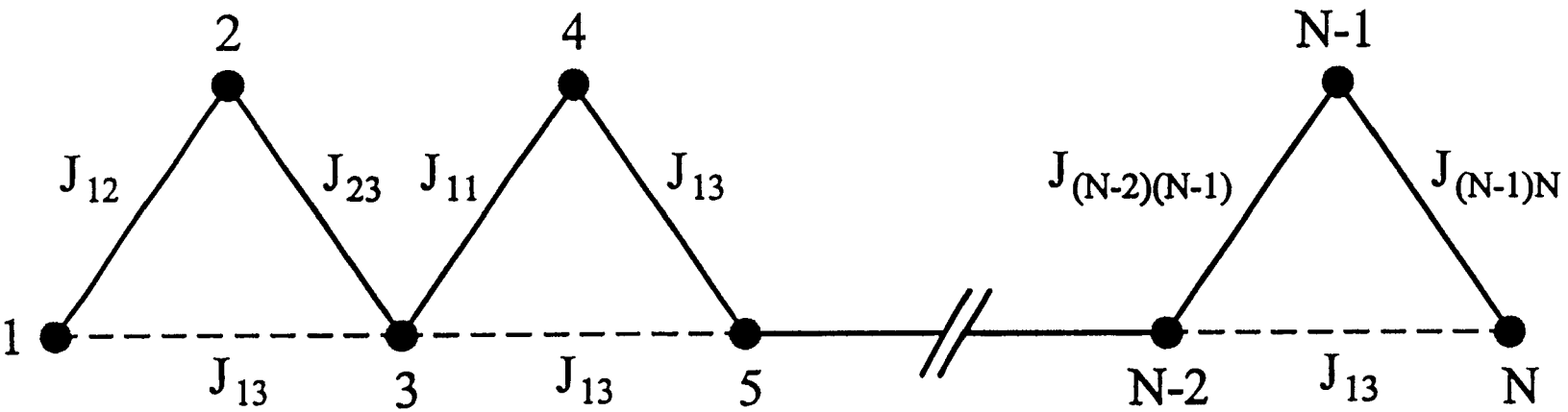
FIG. 1 ( PRIOR ART )
FIG. 1 is a prototype illustrating a cascade trisection bandpass filter.
Figure 2A:
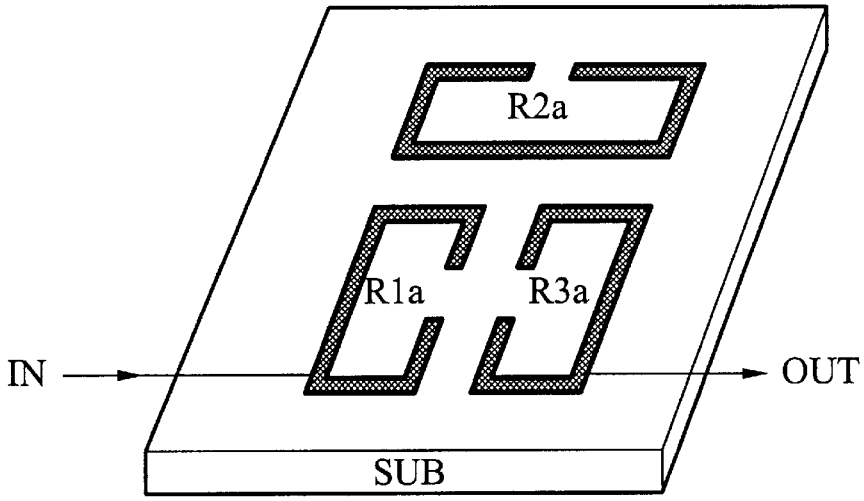
FIG. 2a ( PRIOR ART )
FIG. 2*a* is a typical equivalent circuit of FIG. 1.
Figure 2B:
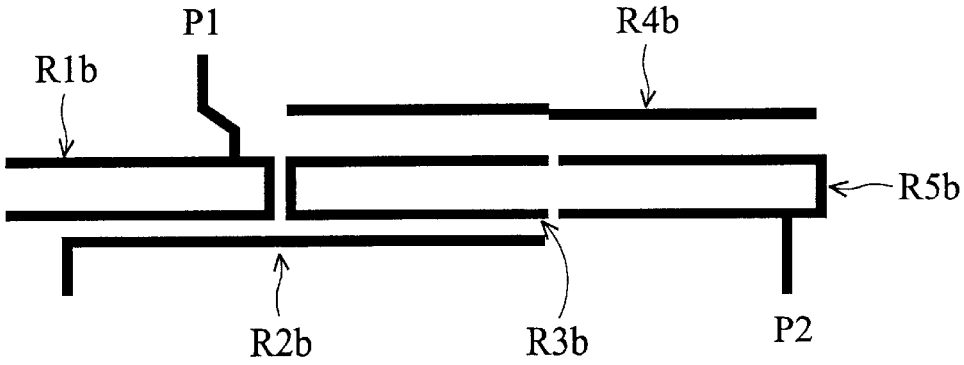
FIG. 2b ( PRIOR ART )
FIG. 2*b* is another typical equivalent circuit of FIG. 1.
Figure 3:
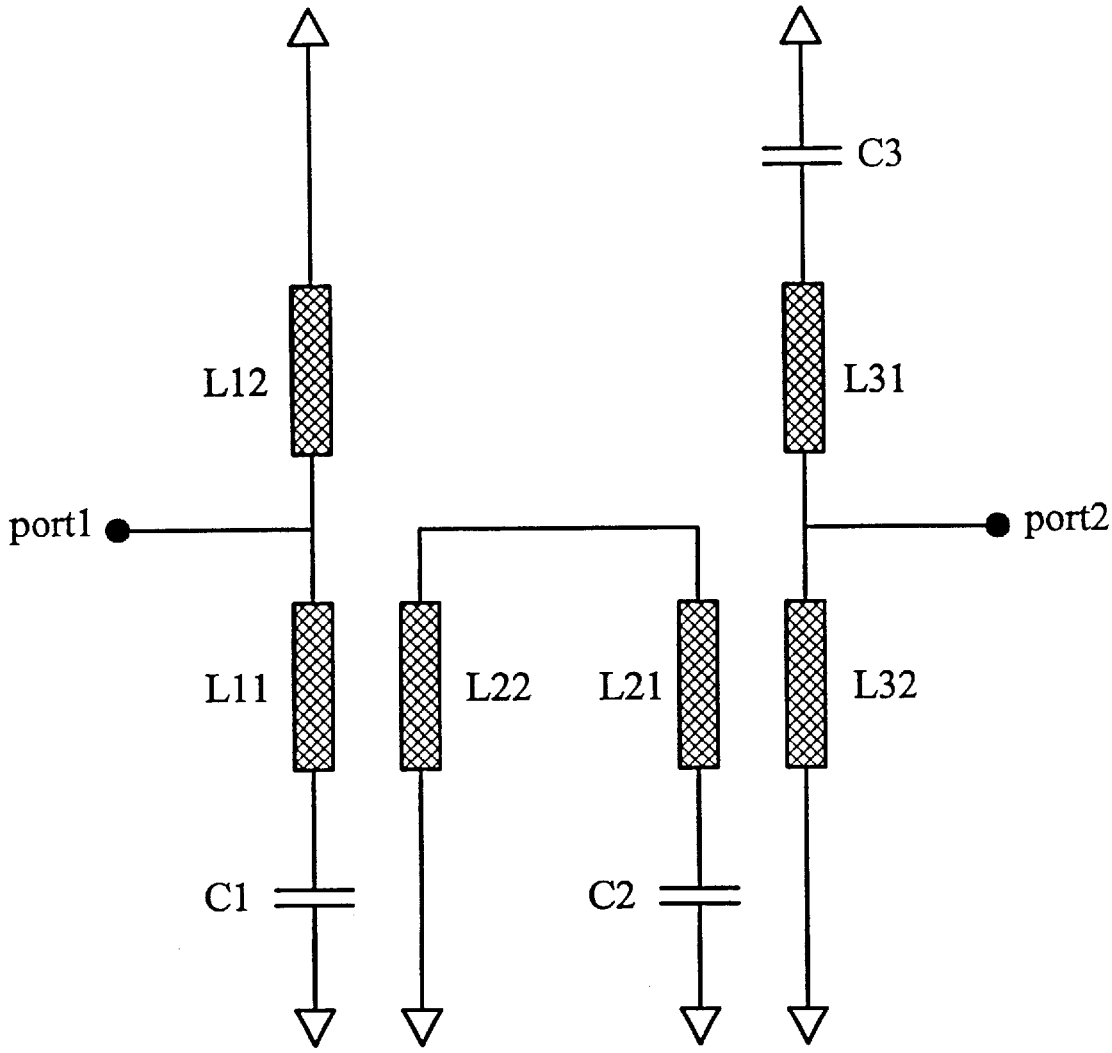
FIG. 3 is an equivalent circuit of the invention.
Figure 4:
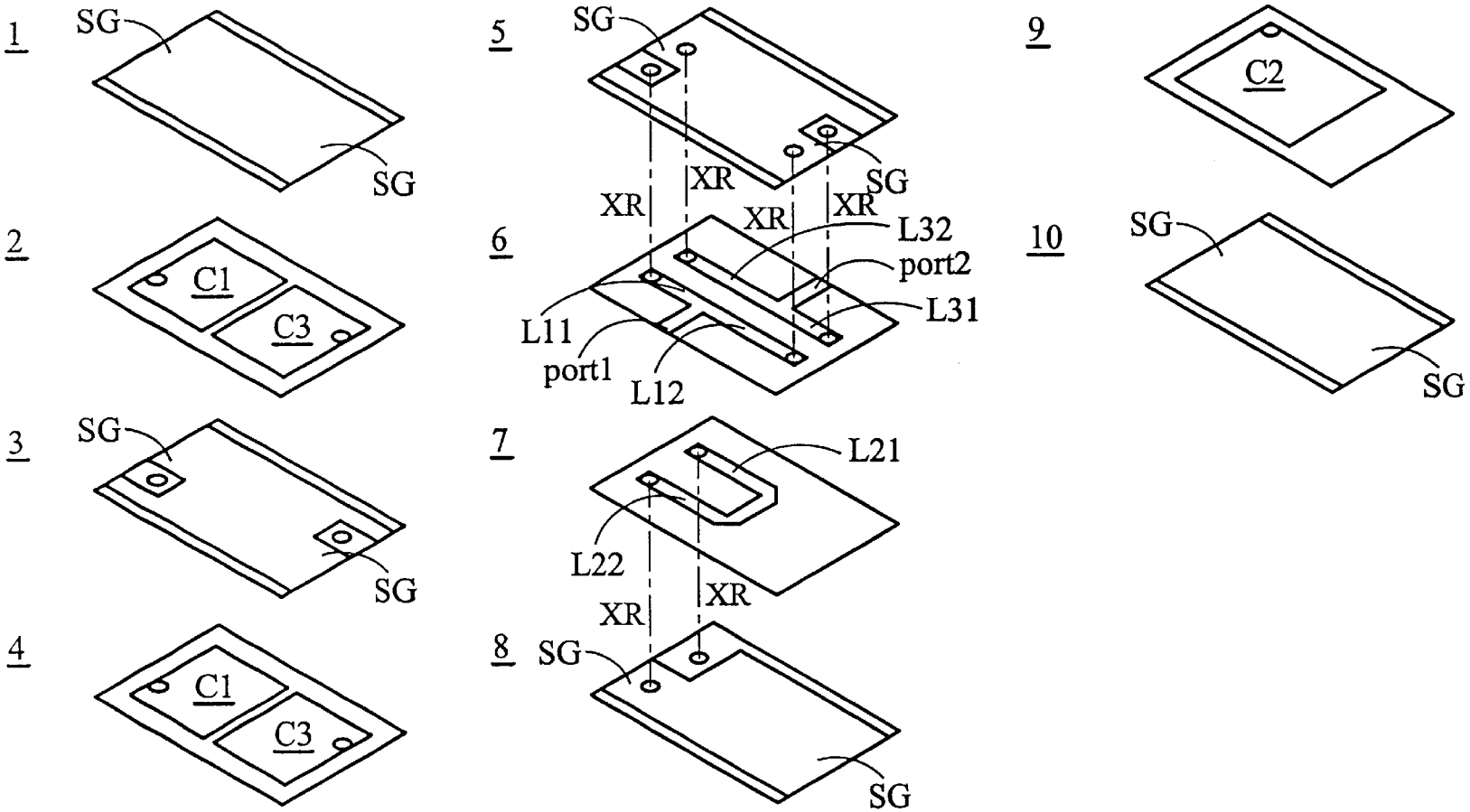
FIG. 4 is an embodiment of FIG. 3 according to the invention.

Appendix A is a curve illustrating typical spurious effect appearing on the structure of FIG. 1;

Appendix B is curves illustrating the frequency change of attenuation poles generated by the structure of FIG. 4 according to the invention; and Appendix C is a curve illustrating a filtering response without spurious effect appearing on the structure of FIG. 3 according to the invention.

DETAILED DESCRIPTION OF THE INVENTION

Refer to FIG. 3, an equivalent circuit of the invention, which is designed by using a semi-lumped LC resonator and according to a prototype of the cascade trisection (CT) bandpass filter structure. In FIG. 3, the circuit includes three resonance units, each having a high impedance transmission line and a serial capacitance device, wherein every high impedance transmission line can consist of two inductance devices.

As shown in FIG. 3, the equivalent circuit of a 3-pole bandpass filter is shown. In such an equivalent circuit, the high impedance transmission portion of the resonator is cross-coupled. A first trisection bandpass resonance unit includes high impedance transmission lines L11, L12 and a capacitance device C1. A second trisection bandpass resonance unit includes high impedance transmission lines L21, L22 and a capacitance device C2. A third trisection bandpass resonance unit includes high impedance transmission lines L31, L32 and a capacitance device C3. The coupling of lines L11 L22 and the coupling of lines L21, L32 are mainly coupled while the coupling of lines L11 L32 and the coupling of the first and third resonance units are cross-coupled. Also, capacitance devices C1, C2, C3 are the ground capacitance. The port Port1 is located between lines L11 and L12, in order to input the signal to the circuit, the port Port2 is located between lines L31 and L32, in order to output the signal of the circuit.

[First Embodiment]

Refer to FIG. 4, an embodiment of FIG. 3. In FIG. 4, a low temperature cofire ceramic technique is carried to a filtering structure with a size 3.2 mm×2.5 mm×1.3 mm and having operating frequency 2.1 GHz, also its explored members included.

As shown in FIG. 4, the embodiment uses nine dielectric layers, with ten metal circuit layers 1–10 with thicknesses of the dielectric layers from top to bottom of 3.6, 3.6, 3.6, 3.6, 7.2, 11.8, 7.2, 3.6 and 3.6 (mil). The ten metal circuit layers 1–4 form a first capacitance layer, the layers 5–8 form an inductance layer, and the layers 9–10 form a second capacitance layer. However, the first capacitance layer can only include the layers 1 and 2, depending on the desired capacitance. The 1, 3, 5, 8 and 10 metal circuit layers are grounded for isolation. The metal line can be silver, copper or any conductive material. The grounding capacitance mentioned above is carried by a metal-insulator-metal (MIM) structure in the embodiment. For example, the capacitance device C2 is an MIM structure forming of the metal layers 8, 9, 10 and insulating dielectric layers to be placed in the middle. Moreover, the capacitance devices C1 and C3 of FIG. 3 are constructed the same as the capacitance C2 of FIG. 4. A need to enlarge the capacitance values is created by increasing the number of layers. The coupling portion (inductance) of the high impedance transmission line mentioned above is achieved by conjoining the layers 5, 6. The main couplings of lines L11, L22 and lines L21, L32 are achieved by the non-coplanar coupling lines. The coupling value is decided by the requirement of bandwidth of the bandpass filter such that the coupling value is changed by the coupled overlap width or the dielectric thickness between the coupling lines. The couplings of lines L11, L12 and lines L31, L32 are carried by edge coupling of the coplanar coupling lines. Such a coupling value can adjust the frequencies of attenuation poles without changing the bandwidth and central frequency of the bandpass filter (see the appendix B, from the point A with 1.7 GHz shift to the point B with 1.45 GHz). Every line can be any conductive material, such as gold, copper, tin or others. The combination of every layer is achieved by vias, e.g. using lines XR through the corresponding vias between the layers, as shown in FIG. 4.

In a multilayer structure, the coupling line used in the embodiment has the advantages of small size and high yield.

[Second Embodiment]

Figure 5:
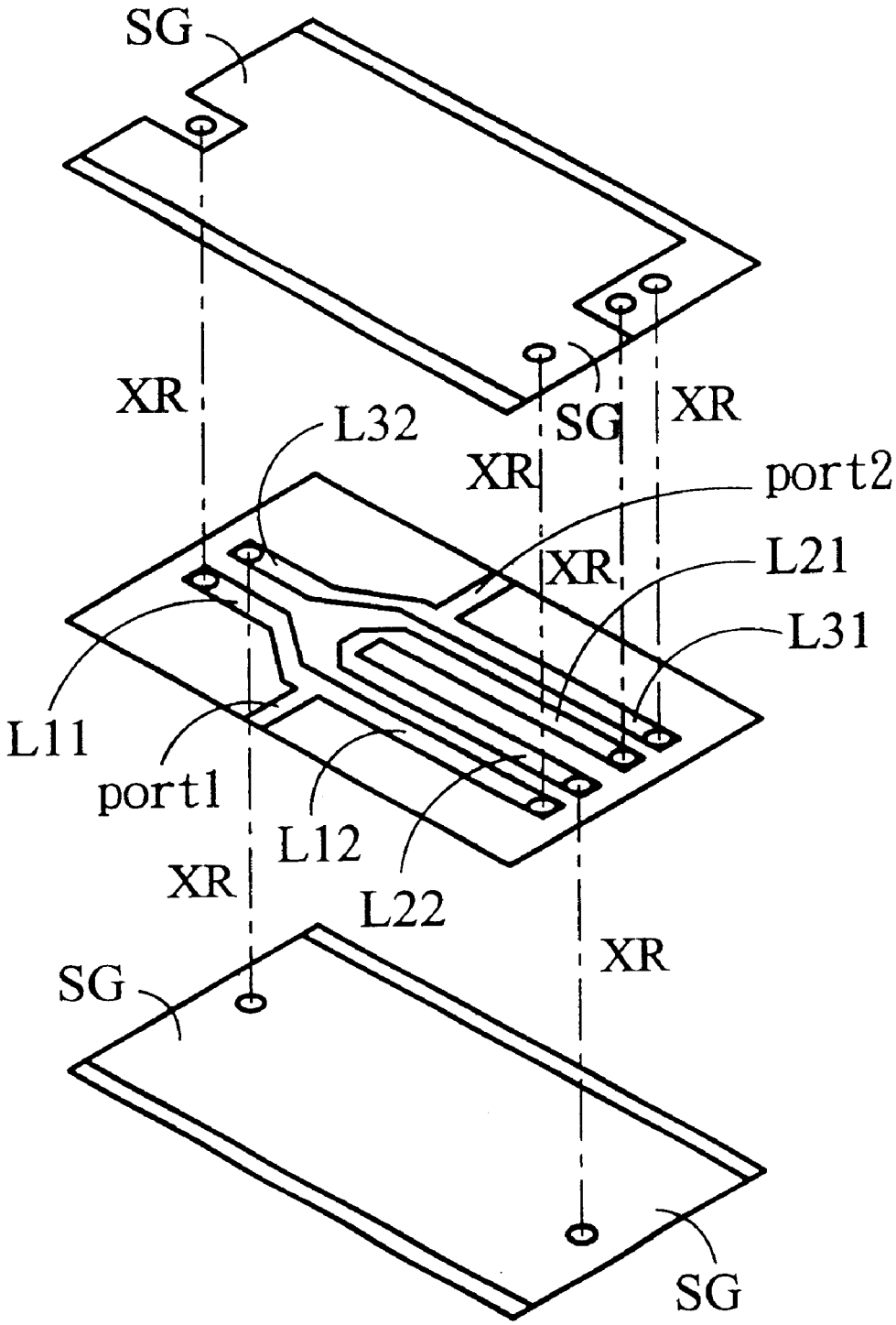
FIG. 5 is another embodiment of the high impedance transmission portion of FIG. 3 according to the invention.

Refer to FIG. 5, further illustrating another embodiment of the high impedance transmission portion (i.e., the layers 4–8 of FIG. 4 can be replaced by this embodiment and the remaining layers are the same) of FIG. 3. The implementation of the capacitance devices C1, C2, C3 of the embodiment is omitted because they are the same as the implementation of the capacitance of FIG. 4. The implementation of the high impedance transmission line follows.

As shown in FIG. 5, the high impedance transmission lines (inductive portion of the resonator) are between top metal plate and bottom metal plate forming strip-lines. The two metal plates use the edge grounding for isolation. The metal line can be copper or any conductive material. The layer 2 is a line layer with the layout of the transmission degrees L1, L2, L3 inside. The transmission lines L1, L2, L3 use edge couple differ from the first embodiment case. The advantage of this embodiment is that the structure can be implemented by a single-layer double sided PCB. Such a coupling value can adjust the frequencies of attenuation poles without changing the bandwidth and central frequency of the bandpass filter. Every line can be any conductive material, e.g. gold, copper, tin or others.

The advantage of the embodiment is its simple structure, which can be implemented by a two-face single board due to the coplanar layout of the capacitors.

Briefly, the resonator with the input port and the resonator with the output port have to implement in coplanar, and the metal layer and the insulator layer are interlaced in implementation. Therefore, various alterations and modifications in the circuit layout of the invention can be made.

Accordingly, the invention provides a small size cross-coupled trisection filtering structure, which minimizes bandpass filtering structure using a multilayer configuration, and adjusts the attenuation pole on both sides of the band pass to avoid the spurious effect appearing on odd frequencies of the bandpass (see appendix C, only one bandpass). Thus the filtering design will satisfy the specific demands.

Although the present invention has been described in its preferred embodiment, it is not intended to limit the invention to the precise embodiment disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A cross-coupled trisection filtering structure, comprising:

first resonance unit, having a first inductance device and a second inductance device connected to a first grounding capacitance device;

a second resonance unit, having a third inductance device, which produces the main coupling with the second inductance device, and a fourth inductance device connected to a second grounding capacitance device; and a third resonance unit, having a fifth inductance device, which produces the main coupling with the fourth inductance device, and a sixth inductance device connected to a third grounding capacitance device, wherein the first and sixth inductance devices are cross-coupled.

2. The filtering structure of claim 1, wherein all resonance units are coplanar.

3. The filtering structure of claim 1, further comprising a cross-coupling between the first and third resonance units.

4. The filtering structure of claim 1, further comprising an input port positioned between the first and second inductance devices.

5. The filtering structure of claim 1, further comprising an output port positioned between the fifth and sixth inductance devices.

6. The filtering structure of claim 1, wherein the first and third resonance units are coplanar.

7. A cross-coupled trisection filtering structure, comprising:

at least one capacitance layer, formed of capacitor electrodes provided for an upper surface of a second dielectric layer, to shield electrodes provided for an upper surface of a first and gird dielectric layers;

an inductance layer, to fold an electrode of one inductor such that all inductors formed on the inductance layer are coupled to each other and shield electrodes formed on the inductance layer are provided for an upper surface of a fifth and eighth dielectric layers; and at least one second capacitance layer, formed of capacitor electrodes provided for an upper surface of a ninth dielectric layer, to shield electrodes provided for an upper surface of the eighth dielectric layer and a bottom surface of the ninth dielectric layer, wherein the-inductors formed on the inductance layer are connected to the first and second capacitance layers through via-hole to form a three-order filter.

8. The filtering structure of claim 7, wherein the three-order filter further has a first trisection resonant unit with an input port, a second trisection resonant unit, and a third trisection resonant unit with an output port.

9. The filtering structure of claim 8, wherein each unit of the three-order filter has an inductor and a capacitor.

10. The filtering structure of claim 9, wherein the serial value of the inductance device and the capacitance device is ranged on the passband.

11. The filtering structure of claim 8, wherein the first and third trisection resonant units of the three-order filter are on the same surface of the dielectric layer.

12. The filtering structure of claim 8, wherein all units of the three-order filter are on the same surface of the dielectric layer.

13. The filtering structure of claim 8, wherein the second trisection resonant unit of the three-order filter is non-coplanar with other units.

* * * * *